US009260908B2

(12) United States Patent
Lu

(10) Patent No.: US 9,260,908 B2
(45) Date of Patent: Feb. 16, 2016

(54) TOUCH-CONTROL INTEGRATED CABINET

(71) Applicant: Wei Lin Lu, Dong Guan (CN)

(72) Inventor: Wei Lin Lu, Dong Guan (CN)

(73) Assignee: DONG GUAN SONG WEI ELECTRIC TECHNOLOGY CO., LTD., Dong Guan, Guang Dong (CN)

( * ) Notice: Subject to any disclaimer, the term of this patent is extended or adjusted under 35 U.S.C. 154(b) by 335 days.

(21) Appl. No.: 13/969,463

(22) Filed: Aug. 16, 2013

(65) Prior Publication Data

US 2015/0048728 A1 Feb. 19, 2015

(51) Int. Cl.

| | |
|---|---|
| ***F25D 31/00*** | (2006.01) |
| ***E06B 3/70*** | (2006.01) |
| ***E06B 3/36*** | (2006.01) |
| ***F25D 23/10*** | (2006.01) |
| ***F25D 29/00*** | (2006.01) |

(52) U.S. Cl.

CPC . *E06B 3/70* (2013.01); *E06B 3/367* (2013.01); *F25D 23/10* (2013.01); *F25D 29/005* (2013.01); *F25D 2331/803* (2013.01); *F25D 2400/361* (2013.01)

(58) Field of Classification Search

CPC ..... E06B 3/70; F25D 31/00; F25D 11/00

See application file for complete search history.

(56) References Cited

U.S. PATENT DOCUMENTS

| | | | | |
|---|---|---|---|---|
| 5,415,005 | A * | 5/1995 | Sterber | F25D 21/006 62/154 |
| 6,098,411 | A * | 8/2000 | Jeon | F25D 29/005 236/94 |
| 8,020,401 | B2 * | 9/2011 | Chen | F25D 17/062 622/298 |
| 2003/0183645 | A1 * | 10/2003 | Shin | G07F 11/10 221/133 |
| 2011/0214440 | A1 * | 9/2011 | Kueny | F25B 49/00 62/125 |
| 2013/0000331 | A1 * | 1/2013 | Hagiwara | F25D 11/00 62/126 |
| 2014/0220833 | A1 * | 8/2014 | Kerner | H01R 43/00 439/834 |

* cited by examiner

*Primary Examiner* — Fred Tzeng

(57) ABSTRACT

A touch-control integrated cabinet includes a temperature control cabinet, a decoration cabinet and an integral cabinet door. One side of the temperature control cabinet has a temperature control cabinet opening. One side of the decoration cabinet has a decoration cabinet opening. The temperature control cabinet opening corresponds in position to the decoration cabinet opening. The cabinet door is pivotally connected to both the temperature control cabinet opening and the decoration cabinet opening to seal the temperature control cabinet opening and the decoration cabinet opening. A touch-control device is provided on the cabinet door for controlling the internal temperature of the temperature control cabinet. The traditional temperature control cabinet door and the decoration cabinet door are combined into an integrated cabinet door. The user can touch and operate the buttons on the surface of the cabinet door to control the internal temperature of the temperature control cabinet.

9 Claims, 9 Drawing Sheets

TOUCH-CONTROL INTEGRATED CABINET

BACKGROUND OF THE INVENTION

1. Field of the Invention

The present invention relates to a cabinet door technique, and more particularly to a touch-control integrated cabinet.

2. Description of the Prior Art

With the development of times, a wine cabinet 1 is widely used instead of a conventional wine cellar. As shown in FIG. 1 and FIG. 2, a traditional wine cabinet 1 comprises a wine cabinet body 2, a wine cabinet door 3. The wine cabinet door 3 is pivotally connected to the wine cabinet body 2. When the wine cabinet door 3 is closed, a sealed chamber 4 is formed inside the wine cabinet 1. A temperature control device is provided in the wine cabinet body 2. The wine cabinet door 3 is mounted with a mechanical switch or a touch button 5. The mechanical switch or the touch button 5 of the wine cabinet door 3 is connected with the temperature control device to control the temperature control device. This ensures that a proper temperature is maintained for the stored wine.

These days, people are fastidious about the appearance of the wine cabinet 1. Therefore, a decoration cabinet 6 is fitted on the traditional wine cabinet 1, as shown in FIG. 3. The decoration cabinet door 7 of the decoration cabinet 6 and the wine cabinet door 3 of the traditional wine cabinet 1 are arranged at the same side. The existing wine cabinet 1 and the decoration cabinet 6 are of a simple structure. It needs two doors to open the cabinets. Because the mechanical switch or the touch button 5 is mounted on the wine cabinet door 3, the wine cabinet door 3 is unable to unit with the decoration cabinet door 7 to make a door. When the user wants to adjust the temperature of the wine cabinet 1, he/she needs to open the decoration cabinet door 7 first, and then operates the mechanical switch or the touch button 5 on the wine cabinet door 3, which is not convenient for use. If the door of the wine cabinet 1 is opened frequently, the temperature of the wine cabinet will rise and spoil the wine.

Accordingly, the inventor of the present invention has devoted himself based on his many years of practical experiences to solve these problems.

SUMMARY OF THE INVENTION

The primary object of the present invention is to provide a touch-control integrated cabinet to overcome the shortcomings of the prior art. The temperature control cabinet door and the decoration cabinet door are combined into an integral cabinet door. The outer surface of the integral cabinet door is provided with a touch-control panel for the user to operate conveniently.

In order to achieve the aforesaid object, the touch-control integrated cabinet of the present invention comprises a temperature control cabinet, a decoration cabinet and an integral cabinet door. One side of the temperature control cabinet has a temperature control cabinet opening. One side of the decoration cabinet has a decoration cabinet opening. The temperature control cabinet opening corresponds in position to the decoration cabinet opening. The cabinet door is pivotally connected to both the temperature control cabinet opening and the decoration cabinet opening to seal the temperature control cabinet opening and the decoration cabinet opening. A touch-control device is provided on the cabinet door for controlling the internal temperature of the temperature control cabinet.

Preferably, the cabinet door comprises a front door board, a rear door board which is secured to the rear of the front door board and turned along with the front door board, and a gap defined between the front door board and the rear door board. The touch-control device comprises a touch-control panel, a master control drive panel and touch-control units. The master control drive panel is fixed on the rear door board. The touch-control units are connected between the touch-control panel and the master control drive panel and located in the gap between the front door board and the rear door board.

The present invention combines the traditional temperature control cabinet door and the decoration cabinet door into one integral cabinet door. The touch-control device is provided on the front door board of the cabinet door. The user can touch and operate the buttons on the surface of the front door board of the cabinet door to control the internal temperature of the temperature control cabinet, without opening the cabinet door. This is very simple and convenient, which solves the problem that the front door of the decoration cabinet used for the temperature control cabinet doesn't have the console. Besides, after the temperature control cabinet and the decoration cabinet are combined, only one door is required. It is convenient to produce and process the integrated cabinet so as to lower the cost. The front door of the conventional temperature control cabinet and the decoration cabinet has the operation panel mounted inside the temperature control cabinet, or the prior art has two doors. Because the console is mounted inside the temperature control cabinet, the user has to open the door of the temperature control cabinet for adjusting the temperature or operating the other functions. In this way, the outside air may enter the cabinet easily to spoil the food, and the temperature control cabinet is unable to be maintained at a constant temperature. The present invention is a novel design and breakthrough.

DETAILED DESCRIPTION OF THE PREFERRED EMBODIMENTS

Figure 1:
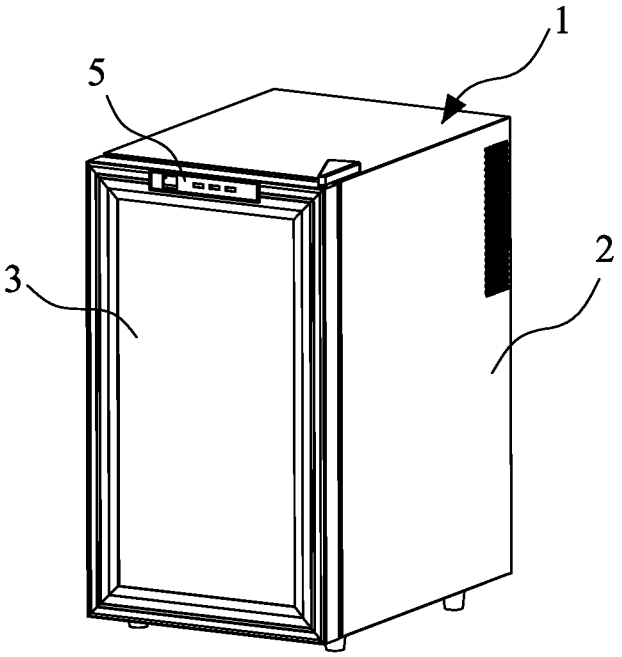
F I G. 1 Prior Art
FIG. 1 is a schematic view of a conventional wine cabinet.
Figure 2:
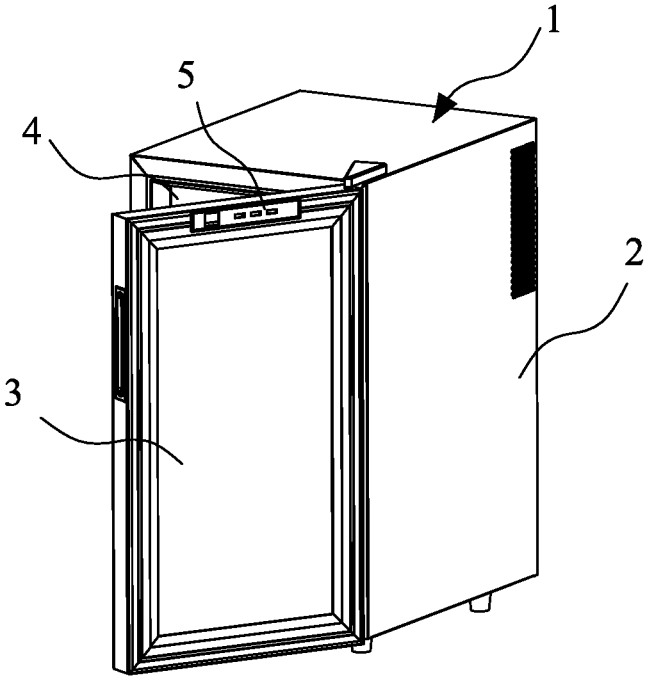
F I G. 2 Prior Art
FIG. 2 is a schematic view of the conventional wine cabinet to show that the cabinet door is opened.
Figure 3:
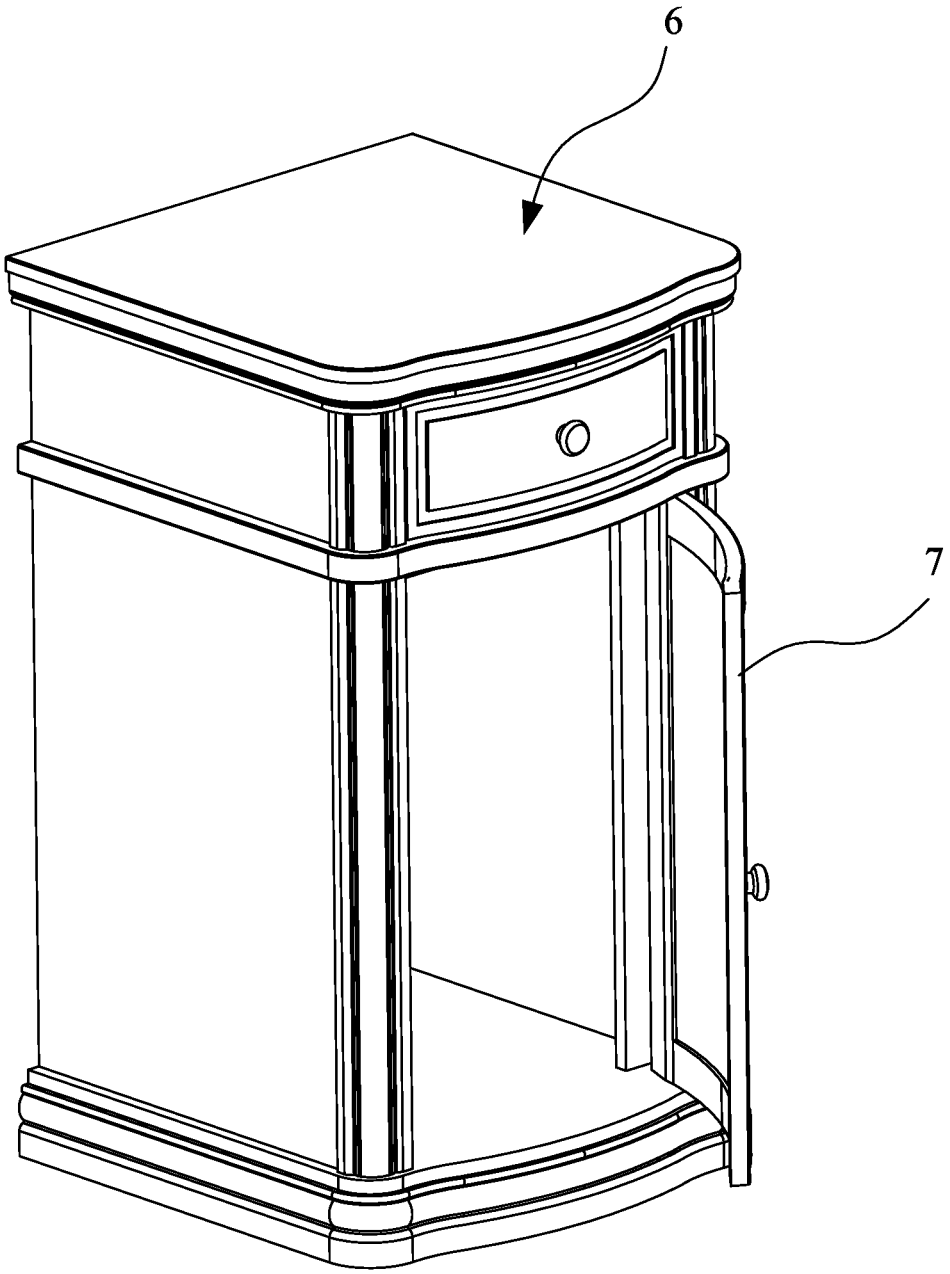
FIG. 3 Prior Art
FIG. 3 is a perspective view showing the decoration cabinet fitted on the conventional wine cabinet.
Figure 4:
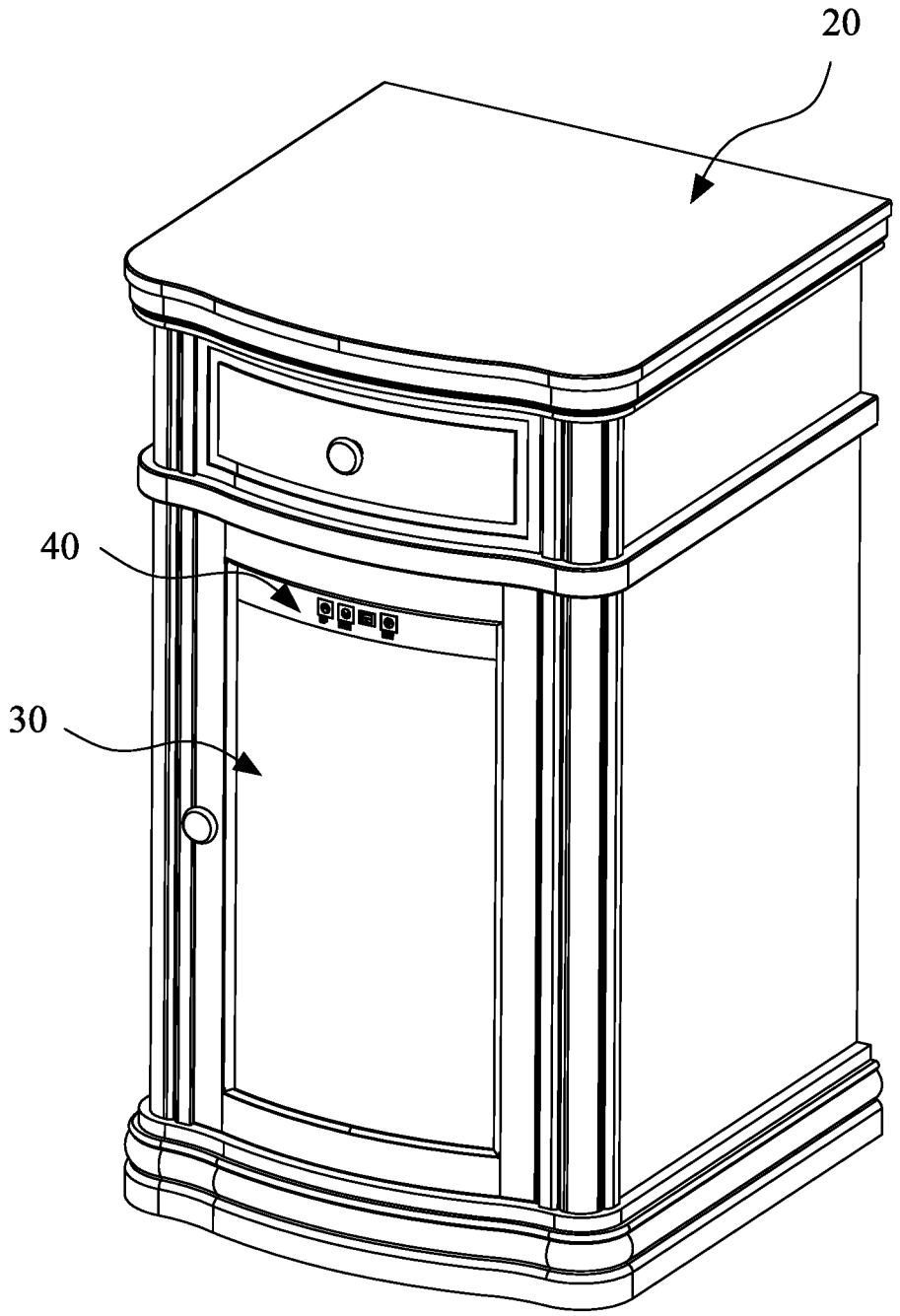
FIG. 4 is a perspective view showing the assembly of the wine cabinet (the temperature control cabinet) and the decoration cabinet according to a preferred embodiment of the present invention when in use.
Figure 5:
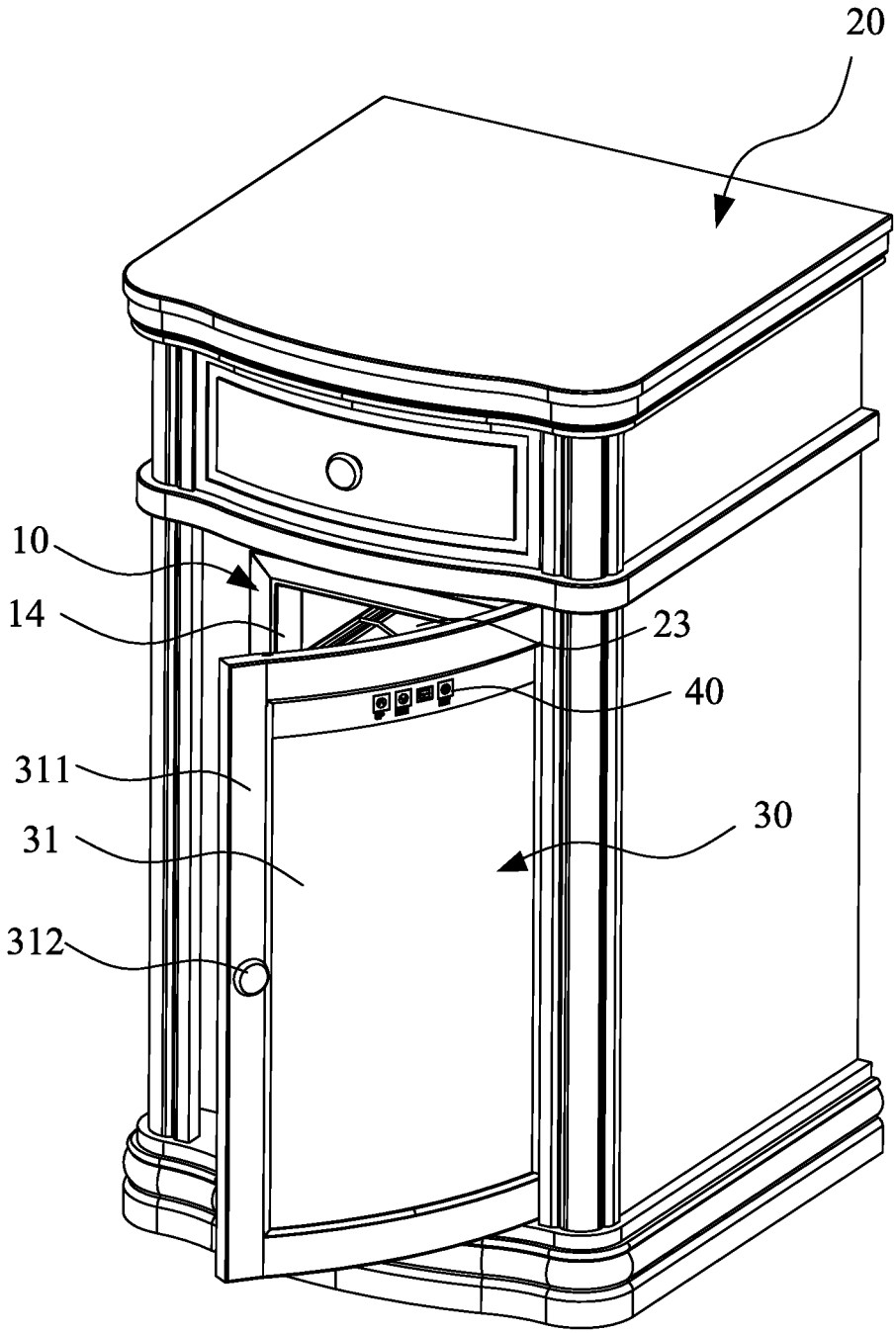
FIG. 5 is a schematic view of FIG. 4 with the cabinet door opened.
Figure 6:
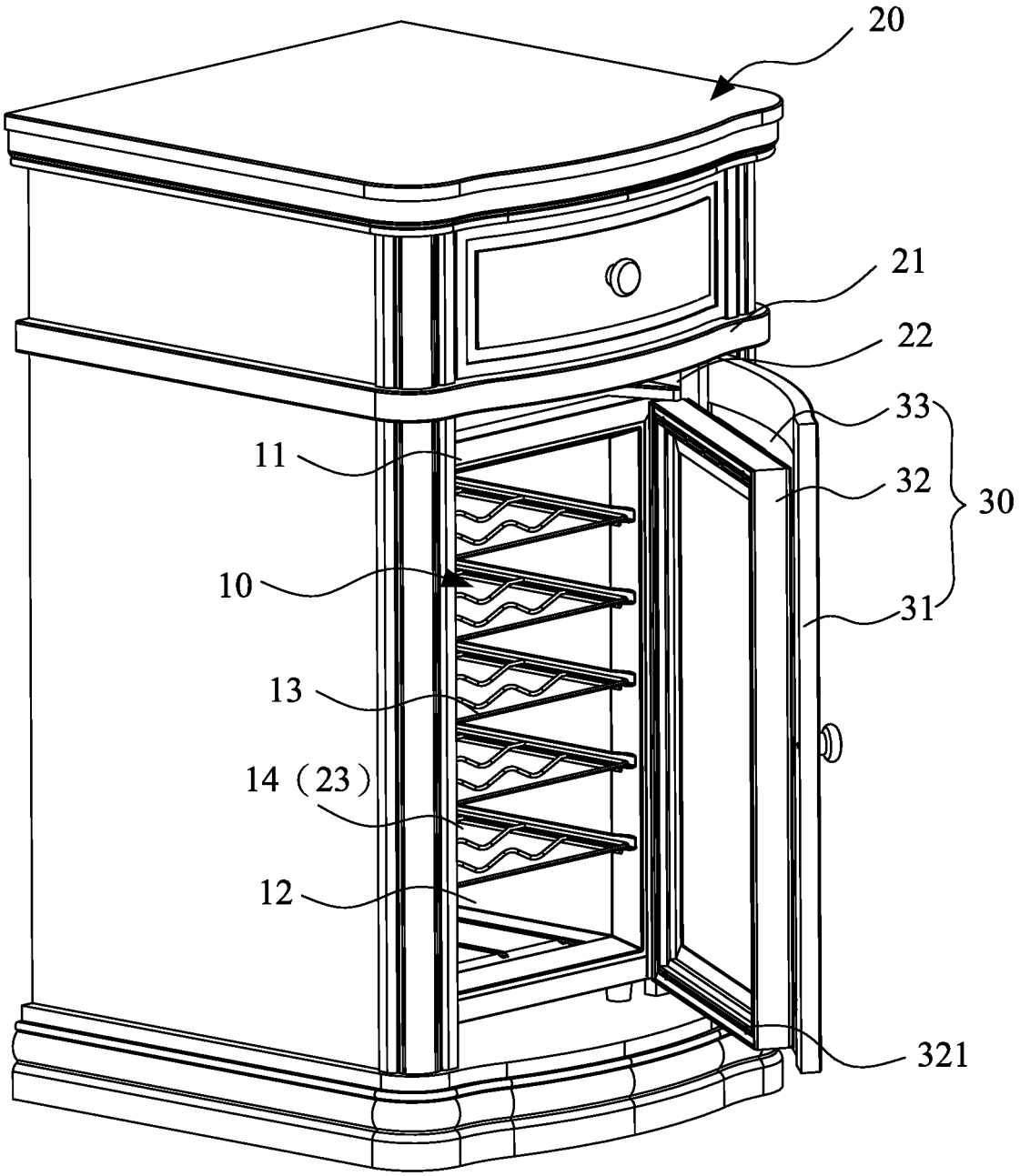
FIG. 6 is another perspective view of FIG. 5.
Figure 7:
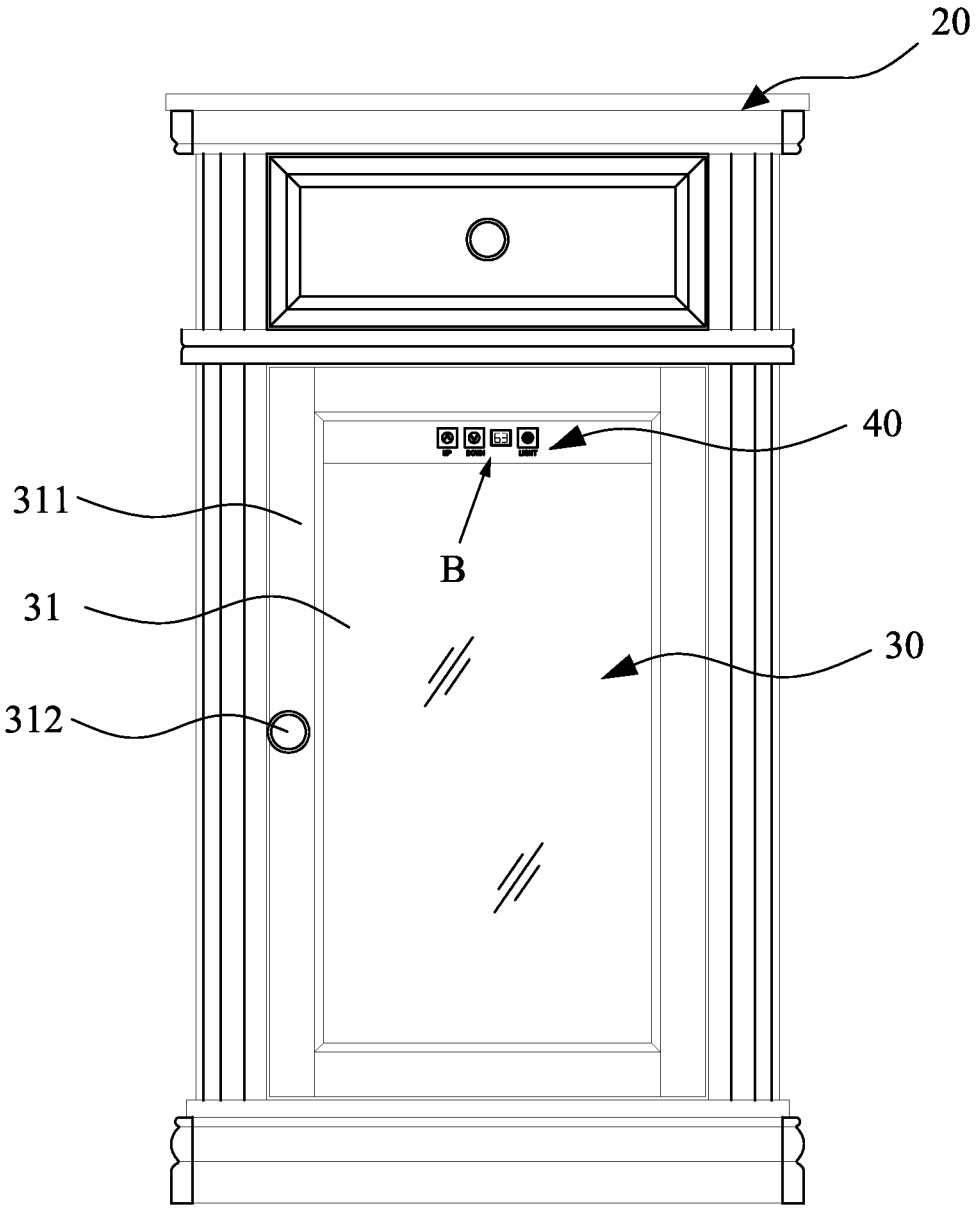
FIG. 7 is a front view of FIG. 4.
Figure 8:
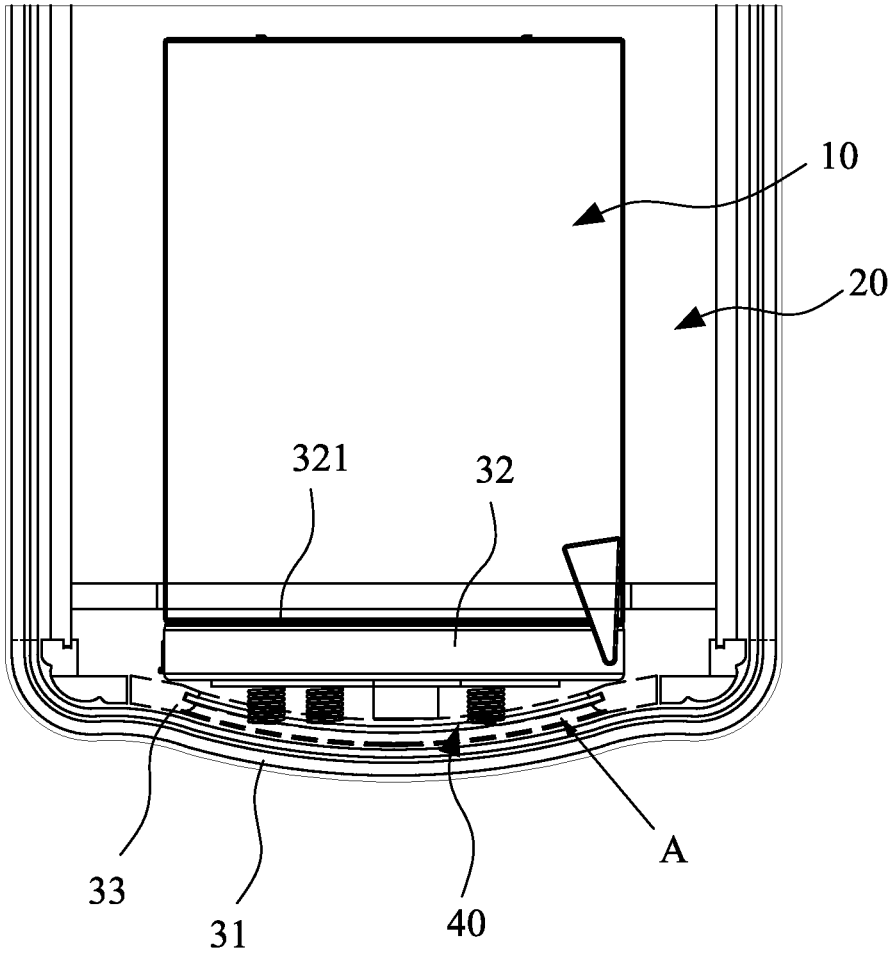
FIG. 8 is a top view of FIG. 4.

Embodiments of the present invention will now be described, by way of examples only, with reference to the accompanying drawings.

As shown in FIG. 3 to FIG. 11, the touch-control combined cabinet according to a preferred embodiment of the present invention comprises an inner temperature control cabinet 10 and an outer decoration cabinet 20. In this embodiment, the inner temperature cabinet 10 is a wine cabinet, but not limited to the wine cabinet, it can be a refrigerating cabinet, a bowl cabinet, a baking cabinet, a sterilizing cabinet or the like. Both the inner temperature control cabinet 10 and the outer decoration cabinet 20 are jointly mounted to an integral cabinet door 30.

The temperature control cabinet 10 comprises a temperature control cabinet body 11. The temperature control cabinet body 11 has an accommodation chamber 12 therein. The accommodation chamber 12 is mounted with a plurality of shelves 13 for placing wine bottles therein. A temperature control device is provided in the temperature control cabinet 10 to set the temperature of the accommodation chamber 12 in the range of a set lower temperature so as to keep the food (wine). The front side of the temperature control cabinet 10 has a temperature control cabinet opening 14 for mounting the cabinet door 30 thereupon.

The decoration cabinet 20 can be designed in a simple style, a rural style, an European classic style, a Mediterranean style, an American country style, a Japanese style and so on. The decoration cabinet 20 comprises a decoration cabinet body 21. The decoration cabinet body 21 comprises a bottom board, a top board, a left board, a right board and a rear board to define a hollow chamber 22 therein. The temperature control cabinet 10 is placed in the hollow chamber 22. The ordinary simple temperature control cabinet 10 has the decoration cabinet 20 as its appearance so that the temperature control cabinet 10 can integrate into the style of other household appliances. Thus, the appearance of the product is more appealing, providing a harmony effect. The front side of the decoration cabinet 20 has a decoration cabinet opening 23 for mounting the cabinet door 30 thereupon.

The cabinet door 30 is to designed to combine the traditional temperature control cabinet door and the decoration cabinet door into an integral cabinet door 30. The cabinet door 30 is pivotally connected to the side edges of both the temperature control cabinet opening 14 and the decoration cabinet opening 23. When the cabinet door 30 is opened, the temperature control cabinet opening 14 and the decoration cabinet opening 23 are opened simultaneously. When the cabinet door 30 is closed, the temperature control cabinet opening 14 and the decoration cabinet opening 23 are closed simultaneously.

The cabinet door 30 comprises a front door board 31, a rear door board 32 which is secured to the rear of the front door board 31 and turned along with the front door board 31, and a gap 33 defined between the front door board 31 and the rear door board 32. The front door board 31 is a flat or curved panel made of a plank, a plastic material or a glass material. The front door board 31 has a decoration rim 311 on a circumferential portion thereof. The front door board 31 and the decoration rim 311 are to seal the decoration cabinet opening 23 together. The surface of the front door board 31 can be printed with different colors or patterns to beautify the cabinet. A handle 312 is provided on the decoration rim 311 for opening/closing the cabinet door 30 conveniently.

The rear door board 32 is adapted to seal the temperature control cabinet opening 14. The outer edge of the rear door board 32 is covered by the decoration rim 311 so that the whole cabinet presents a wholisic look. In order to ensure the seal effect of the cabinet door 30, the inner edge of the rear door board 32 is provided with a seal strip 321. After the cabinet door 30 is closed, the temperature control cabinet opening 14 will be sealed tightly to avoid convection of air both inside and outside, resulting in a change of temperature.

Figure 10:
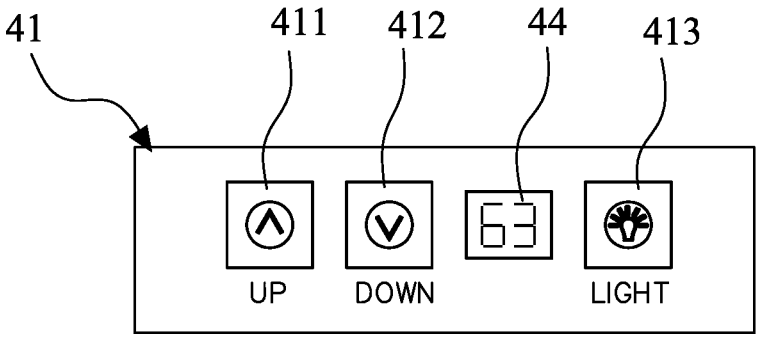
FIG. 10 is an enlarged view of the portion B of FIG. 7.

The cabinet door 30 is provided with a touch-control device 40. The touch-control device 40 comprises a touch-control panel 41, a master control drive panel 42, touch-control units 43 and a temperature display 44. The touch-control panel 41 is directly printed on the front door board 31, and it can be printed at a desired position of the front door board 31. As shown in FIG. 10, the touch-control panel 41 has a printed layer with character information or graphic symbols, such as a temperature up button 411, a temperature down button 412, and a light button 413. The touch-control panel 41 further has a temperature display area for mounting the temperature display 44 thereupon. The master control drive panel 42, the touch-control units 43 and the temperature display 44 are mated with the touch-control panel 41 and mounted in the gap 33 between the front door board 31 and the rear door board 32. The temperature display 44 can be LED nixie tubes or a LCD screen. The console includes one temperature display 44 to show the temperature or several temperature displays 44 to show the temperatures of several areas.

Figure 9:
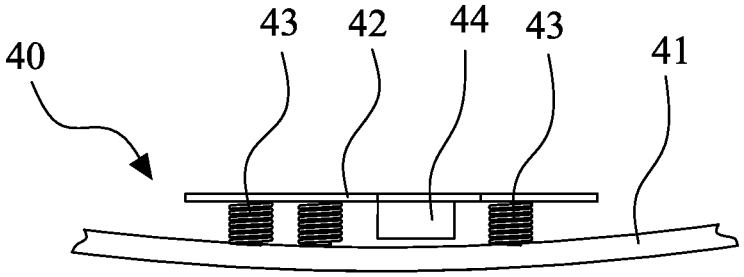
FIG. 9 is an enlarged view of the portion A of FIG. 8.

In this embodiment, as shown in FIG. 9, the rear of the front door board 31 is provided with the touch-control units 43 corresponding to the buttons of the touch-control panel 41. The master control drive panel 42 is fixed on the rear door board 32. The touch-control units 43 are located in the gap 33 between the front door board 31 and the rear door board 32 and held between the buttons of the touch-control panel 41 and the master control drive panel 42. When the user touches one of the buttons of the touch-control panel 41, the corresponding touch-control unit 43 will output a signal to the master control drive panel 42. The master control drive panel 42 controls the temperature control device in the temperature control cabinet 10 to adjust the temperature of the temperature control cabinet 10. Thus, when the cabinet door 30 is closed, the user can operate the button function of the temperature control cabinet 10 through the touch-control panel 41. It does not require a user to open the cabinet door for adjusting the temperature of the temperature control cabinet 10.

Figure 11:
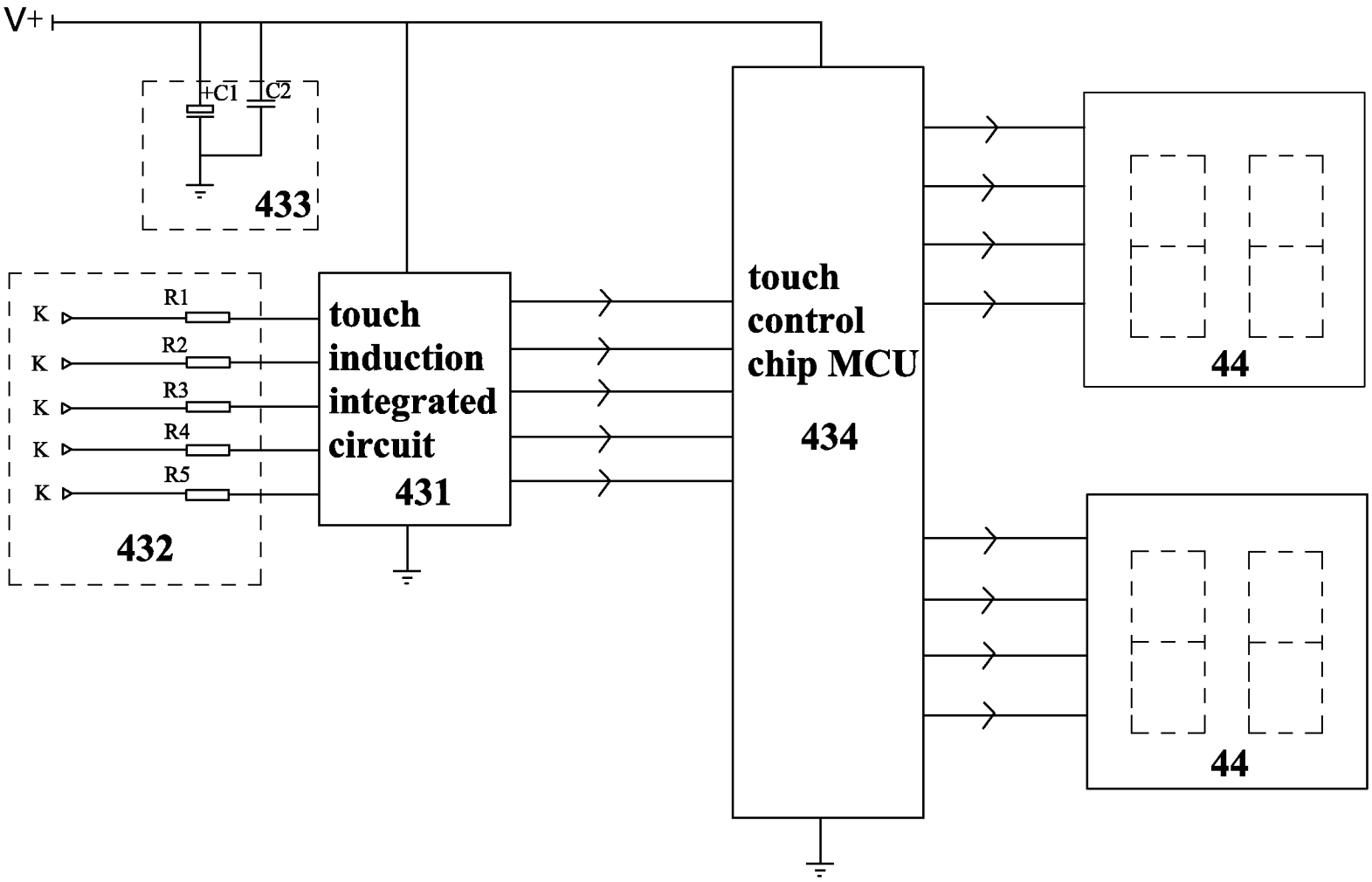
FIG. 11 is a circuit diagram of the touch induction circuit of the touch-control unit according to the preferred embodiment of the present invention.

FIG. 11 shows the circuit diagram of the touch-control device 40. The touch induction circuit of the touch-control device 40 includes a touch control chip MCU 434, induction conductive electrodes and a plurality of resistance capacitances. The induction conductive electrodes and the plurality of resistance capacitances constitute a touch induction integrated circuit 431, a touch induction input circuit 432 and a power filter circuit 433. The touch control chip MCU 434 has a ground terminal and a plurality of signal output terminals. A power source supplies electricity, and the plurality of signal output terminals are respectively connected with a control end of the touch control chip MCU 434 according to internal control logic for outputting a control signal to the temperature display 44 and opening a corresponding load and executing a corresponding program.

The touch induction input circuit 432 includes induction conductive electrodes K and input resistances R1, R2, R3, R4, R5. One end of each induction conductive electrode K is connected with one end of the corresponding input resistance. The other end of the corresponding input resistance is connected with an input end of the touch induction integrated circuit 431. The input signal is processed by the touch induction integrated circuit 431, and then the output signal is sent to the touch control chip MCU 434. In this embodiment, the induction conductive electrodes K are conductive springs or a PCB (printed circuit board) having an electrode induction welding plate.

The temperature display 44 is to show the controlled temperature by means of a signal of the touch induction input circuit 432 and the touch induction integrated circuit 431 to process the signal and the touch control chip MCU 434 to output a drive signal to the temperature display 44. In this embodiment, the temperature display 44 are LED nixie tubes.

The power filter circuit 433 includes an electrolytic capacitor C1 and a ceramic capacitor C2. One end of each of the electrolytic capacitor C1 and the ceramic capacitor C2 is connected to the positive pole V+ of the power source, and the other end of each of the electrolytic capacitor C1 and the ceramic capacitor C2 is connected to the ground terminal of the power source to enhance antijamming capability of the power ripples of the touch induction integrated circuit 431 and the touch control chip MCU 434. The touch induction integrated circuit 431 and the touch control chip MCU 434 share the power source and the ground terminal.

When the finger touches the induction conductive electrode K of the touch induction circuit, the induction conductive electrode K and the finger will form a capacitance impulse signal to input into the touch induction integrated circuit 431 and processed by touch induction integrated circuit 431 to output a corresponding voltage change to the touch control chip MCU 434 for a control command execution. In this way, the temperature control cabinet 10 is operated and controlled by the finger to touch the corresponding buttons. The power of the touch induction integrated circuit 431 and the touch control chip MCU 434 is supplied and filtered by the power source. The touch induction integrated circuit 431 controls the signals and switches the signals to the touch control chip MCU 434 to be processed and then to output a temperature data signal to the temperature display 44. The touch induction signal switch is controlled by the touch induction integrated circuit 431, and the command signal execution is controlled by the touch control chip MCU 434.

The cabinet door 30 is designed to combine the traditional temperature control cabinet door and the decoration cabinet door into one integral cabinet door 30. The touch-control device 40 is provided on the front door board 31 of the cabinet door 30. The user can touch and operate the buttons on the surface of the front door board 31 of the cabinet door 31 to control the internal temperature of the temperature control cabinet 10, without opening the cabinet door. This is very simple and convenient, which solves the problem that the front door of the decoration cabinet 20 used for the temperature control cabinet 10 doesn't have the console. Besides, after the temperature control cabinet 10 and the decoration cabinet 20 are integrated, only one door is necessary. It is convenient to produce and process the integrated cabinet so as to lower the cost. The front door of the conventional temperature control cabinet 10 and the decoration cabinet 20 has the operation panel mounted inside the temperature control cabinet 10, or the prior art has two doors. Because the console is mounted inside the temperature control cabinet 10, the user has to open the door of the temperature control cabinet 10 to adjust the temperature or operate the other functions. In this way, the outside air may enter the cabinet easily to spoil the food, and the temperature control cabinet 10 is unable to be kept at a constant temperature. The present invention is a novel design and breakthrough.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A touch-control integrated cabinet, comprising a temperature control cabinet, a decoration cabinet and an integral cabinet door, one side of the temperature control cabinet having a temperature control cabinet opening, one side of the decoration cabinet having a decoration cabinet opening, the temperature control cabinet opening corresponding in position to the decoration cabinet opening, the cabinet door being pivotally connected to the temperature control cabinet opening and the decoration cabinet opening to seal the temperature control cabinet opening and the decoration cabinet opening, a touch-control device provided on the cabinet door for controlling the internal temperature of the temperature control cabinet, wherein the cabinet door comprises a front door board, a rear door board which is secured to the rear of the front door board and turned along with the front door board, and a gap defined between the front door board and the rear door board, the touch-control device comprising a touch-control panel, a master control drive panel and touch-control units, the master control drive panel being fixed on the rear door board, the touch-control units being connected between the touch-control panel and the master control drive panel and located in the gap between the front door board and the rear door board.

2. The touch-control integrated cabinet as claimed in claim 1, wherein the front door board is a flat or curved panel made of a plank, a plastic material or a glass material.

3. The touch-control integrated cabinet as claimed in claim 1, wherein the front door board has a decoration rim on a circumferential portion thereof, the front door board and the decoration rim being adapted to seal the decoration cabinet opening together, the rear door board being adapted to seal the temperature control cabinet opening.

4. The touch-control integrated cabinet as claimed in claim 3, wherein the decoration rim is to cover an outer edge of the rear door board.

5. The touch-control integrated cabinet as claimed in claim 3, wherein the temperature control cabinet is a wine cabinet, the temperature control cabinet comprising a refrigerant temperature control device therein, an inner edge of the rear door board being provided with a seal strip for sealing the temperature control cabinet opening.

6. The touch-control integrated cabinet as claimed in claim 1, wherein the touch-control panel has a printed layer with character information or graphic symbols, the touch-control panel having a temperature display area for mounting at least one temperature display.

7. The touch-control integrated cabinet as claimed in claim 6, wherein a touch induction circuit of the touch-control device includes a touch control chip MCU, induction conductive electrodes and a plurality of resistance capacitances, the touch control chip MCU having a ground terminal and a plurality of signal output terminals, a power source supplying electricity, the plurality of signal output terminals being respectively connected with a control end of the touch control chip MCU according to internal control logic for outputting a control signal to the temperature display and opening a corresponding load and executing a corresponding program.

8. The touch-control integrated cabinet as claimed in claim 7, wherein the induction conductive electrodes and the plurality of resistance capacitances constitute a touch induction integrated circuit, a touch induction input circuit and a power filter circuit;

the touch induction input circuit including induction conductive electrodes K and input resistances R1, R2, R3, R4, R5, one end of each induction conductive electrode K being connected with one end of a corresponding input resistance, another end of the corresponding input resistance being connected with an input end of the touch induction integrated circuit, an input signal being processed by the touch induction integrated circuit and then an output signal being sent to the touch control chip MCU;

the power filter circuit including an electrolytic capacitor C1 and a ceramic capacitor C2, one end of each of the electrolytic capacitor C1 and the ceramic capacitor C2 being connected to a positive pole V+ of the power source, another end of each of the electrolytic capacitor C1 and the ceramic capacitor C2 being connected to the ground terminal of the power source to enhance antijamming capability of power ripples of the touch induction integrated circuit and the touch control chip MCU, the touch induction integrated circuit and the touch control chip MCU sharing the power source and the ground terminal;

the temperature display being adapted to show a controlled temperature through a signal of the touch induction input circuit and the touch induction integrated circuit to process the signal and the touch control chip MCU to output a drive signal to the temperature display.

9. The touch-control integrated cabinet as claimed in claim 8, wherein the induction conductive electrodes K are conductive springs or a PCB (printed circuit board) having an electrode induction welding plate.

* * * * *